United States Patent [19]

Groh et al.

[11] Patent Number: 4,987,755

[45] Date of Patent: Jan. 29, 1991

[54] HIGH SECURITY LOCK ASSEMBLY

[75] Inventors: Gale A. Groh, Mitchell; George J. Sallade, Springville, both of Ind.

[73] Assignee: The United States of America, as represented by the Secretary of the Navy, Washington, D.C.

[21] Appl. No.: 240,432

[22] Filed: Mar. 4, 1981

[51] Int. Cl.[5] ..... E05B 65/06

[52] U.S. Cl. ..... 70/134; 70/158; 70/167

[58] Field of Search ..... 70/134, 158, 163, 164, 70/167

[56] References Cited

U.S. PATENT DOCUMENTS

| | | | |
|---|---|---|---|
| 1,274,051 | 7/1918 | Jacobson et al. | 70/2 |
| 2,716,882 | 9/1955 | Gill et al. | 70/159 |
| 2,942,449 | 6/1960 | White | 70/1.5 |
| 3,041,866 | 7/1962 | Segal | 70/1.5 |
| 3,572,062 | 3/1971 | Beebe | 70/1.5 |
| 3,968,895 | 7/1976 | Nielsen | 70/158 |
| 3,968,985 | 7/1976 | Nielsen et al. | 292/340 |
| 4,120,182 | 10/1978 | Michelman | 70/158 |
| 4,120,183 | 10/1978 | Walters | 70/159 |
| 4,152,910 | 5/1979 | Swisher | 70/159 |
| 4,234,220 | 11/1980 | Finch | 70/134 |

*Primary Examiner*—Donald P. Walsh

*Attorney, Agent, or Firm*—Harvey David; John Becker; Sol Sheinbein

[57] ABSTRACT

A high security lock assembly having a tang for holding lock shackle pins, with said tang being attached to a first member, such as a bulkhead or a door jamb. A reversible cover, which can be attached to either the left or right side of a second member, such as a door or cover, is attached, as by welding, with a hasp liner. The hasp liner has a side opening sufficiently large to clear the tang and lock shackle pins, but too small for a lock to pass therethrough. The bottom of the hasp liner is open to receive a lock which is engageable with the lock shackle pins to secure the second member with the first member. The reversible cover is provided with a flange which can be welded directly to a door, cover, or hinge.

6 Claims, 2 Drawing Sheets

HIGH SECURITY LOCK ASSEMBLY

BACKAGROUND OF THE INVENTION

The present invention relates to a locking system and more particularly to a locking system for doors and hatches that require high security.

The necessity of locking doors and containers is widely understood. The most universal locking device is a hinged metal strap provided with a slot which fits over a staple and secured by a padlock. Such locking device can, however, readily be opened or broken, and the most common method consists of inserting a long bar into the loop formed by the lock shackle pins and then rotating the bar until the hasp either breaks or separates from the door or closure.

Military installations, including naval ships, are particularly targeted for penetration as their cache of munitions and weapons are coveted by both foreign groups and by local dissident groups. Recently there has been many acts of vandalism, malicious mischief, arson and sabatoge, both ashore and afloat, and it is likely that such acts will continue and even increase in number. It is thus incumbent upon military commanders to increase security and to employ high security locking devices.

SUMMARY OF THE INVENTION

The present invention comprises a tang having lock shackle pins attached thereto and is configured to be attached to a first member, such as a bulkhead or a door jamb. A reversible cover, having an attaching flange, is adaptable for connecting with a door or cover and a hasp liner is secured, as by welding, to the reversible cover. The hasp liner has an aperture in one end which is of sufficient size to pass over the tang and shackle pins, but too small for a lock to pass therethrough. The bottom of the hasp liner is open to receive a lock which is engageable with the lock shackle pins to secure the door or cover with the first member. If desired, the reversible cover can be hinged to provide for additional clearance.

It is therefore a general object of the present invention to provide an improved high security locking assembly.

Another object of the present invention is to provide a locking assembly which prevents ready access to lock shackle pins when in a locked condition.

Still another object of the present invention is to provide a locking assembly which can readily be adapted for use on different configurations of doors and closures.

Other objects, advantages and novel features of the present invention will become apparent from the following detailed description of the invention when considered in conjunction with the accompanying drawings.

DESCRIPTION OF THE PREFERRED EMBODIMENT

Figure 1:
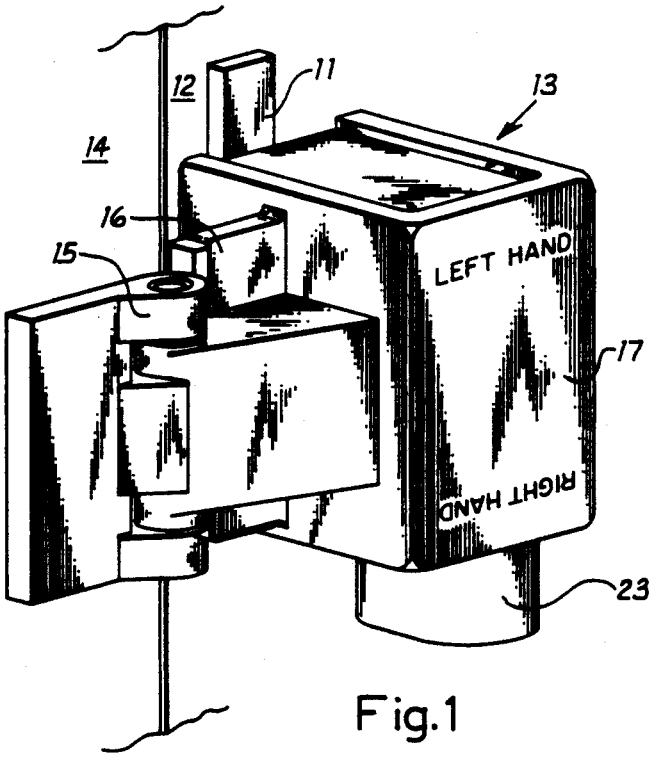
FIG. 1 is an isometric view of a preferred embodiment of the invention having a hinge attachment.
Figure 2:
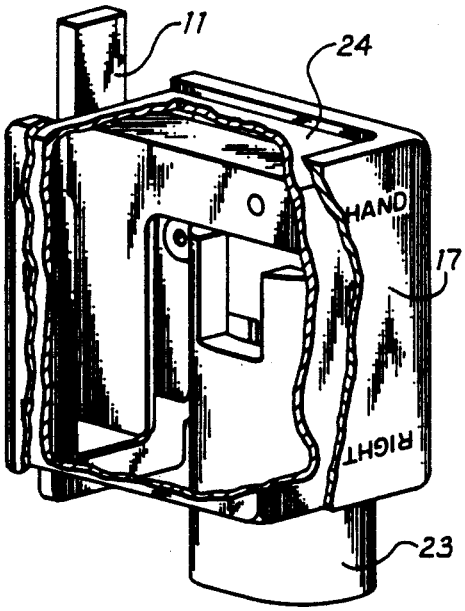
FIG. 2 is an isometric view, partly broken away, of a preferred embodiment.

Referring now to the drawings, a lock assembly is shown with a tang 11 being attached, as by welding, to a non-moving portion of a door hatch 12 and with a cover assembly 13 attached to a door 14 by a hinge 15. Hinge 15 permits cover assembly 13 to be swung out of the door or hatch clear opening to provide additional clearance but, when space is not a limiting factor, flange 16 on reversible cover 17 might be welded, or otherwise attached, directly onto door 14. Tang 11 has an outwardly extending arm 18 and lock shackle 19 is attached to arm 18 by pin 21. Shackle 19 has a pair of pins 22 which are engageable with a lock 23.

Figure 4:
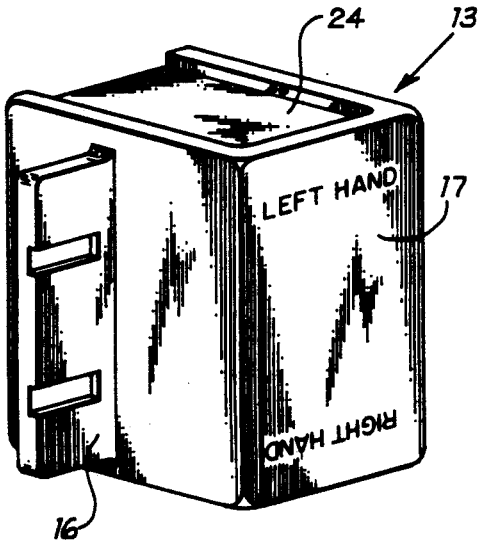
FIG. 4 is an isometric view of a cover positioned for a left hand arrangement.
Figure 5:
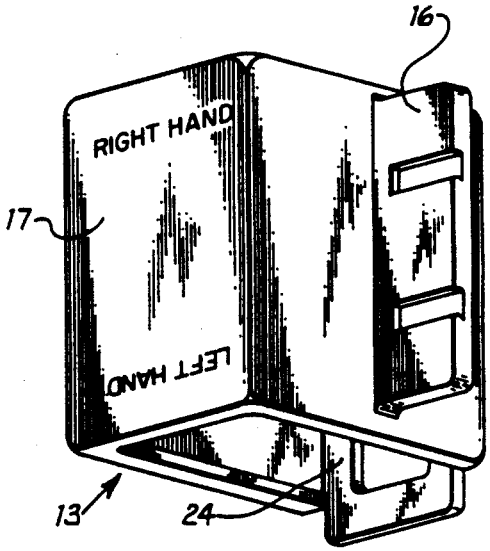
FIG. 5 is an isometric view of the cover shown in FIG. 4, positioned for a right hand arrangement.
Figure 3:
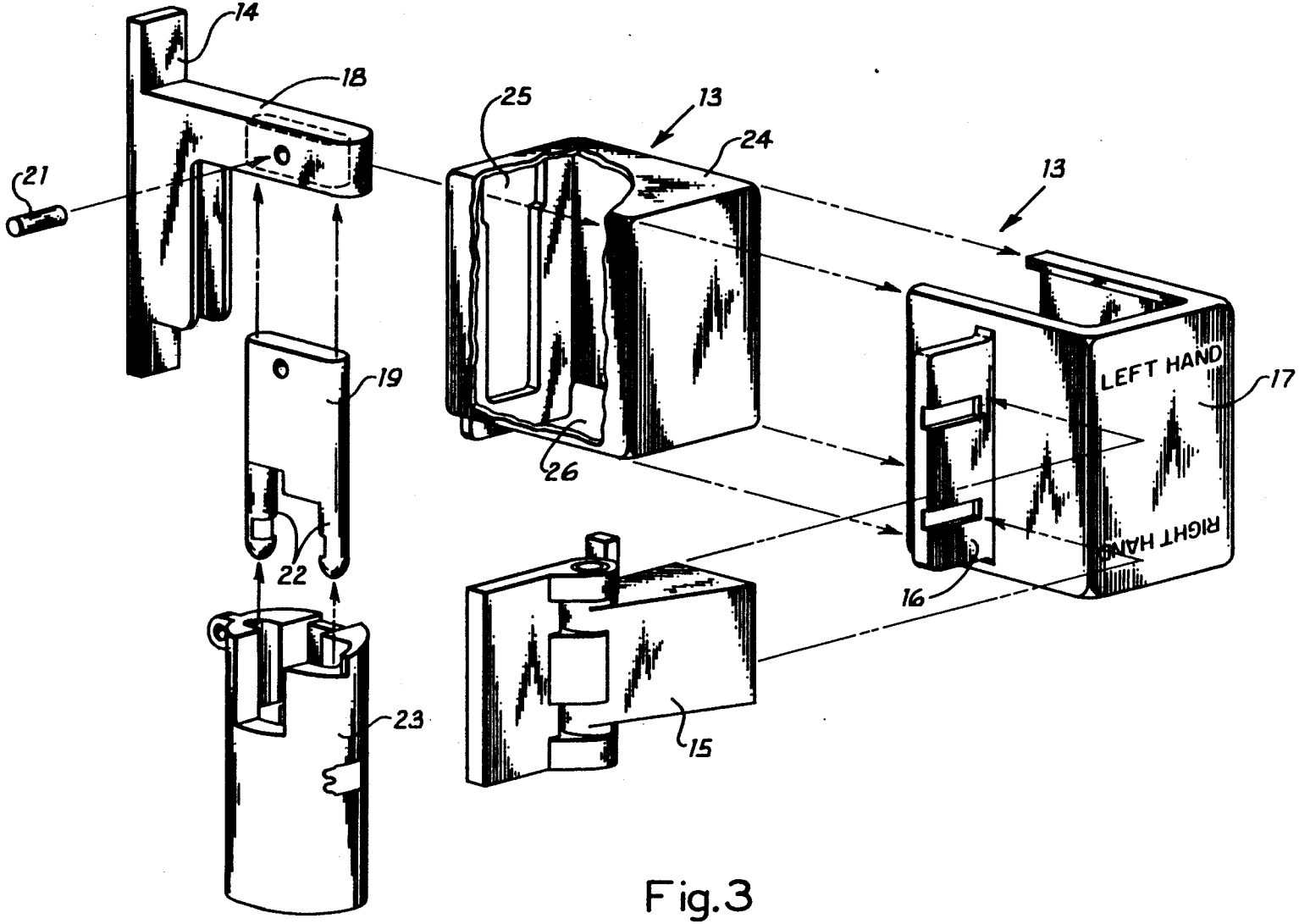
FIG. 3 is an exploded view of a preferred embodiment.

As best shown in FIGS. 4 and 5 of the drawings, reversible cover 17 is substantially U-shaped with openings in one end, the top and the bottom. A hasp liner 24, which provides the primary security structure, fits within reversible cover 17 and is welded thereto. Liner 24, which has an end opening 25 and a bottom opening 26, closes the top opening of reversible cover 17. End opening 25 is sufficiently large so that cover assembly 13 will pass over tang 11 and lock shackle 19, however, the size of opening 25 is such that lock 23 cannot pass through. Opening 26 in the bottom of cover assembly 13 is sufficiently large that lock 23 can enter cover assembly 13 and engage lock shackle 19.

The parts of the lock assembly are preferably made of material having high resistance to sawing and impact. By way of example, the various parts might be made of CA-6NM castable stainless steel which has been hardened to Rockwell C-30-C-32.

OPERATION

Assuming the lock assembly is used to secure a door 14, as shown in FIG. 1 of the drawings, and a hinge 15 is used, cover assembly 13 can be rotated away from tang 11 and door 14 can be opened and closed without the necessity of cover assembly 13 passing over tang 11 and lock shackle 19. When door 14 is to be secured, cover assembly 13 is pivoted about hinge 15 and lock shackle 19 and arm 18 of tang 14 pass through end opening 25 and into cover assembly 13. Lock 23 is then passed through bottom opening 26 in liner 24 and engaged with shackle pins 22. As lock 23 is too large to pass through end opening 25, cover assembly 13 cannot move when lock 23 is in position and door 14 is secure. Upon removing lock 23, cover assembly 13 is again free to rotate.

In some situations, hinge 15 can be eliminated and cover assembly 13 can be attached directly to a door by welding, or otherwise attaching, flange 16 thereto. As best shown in FIGS. 4 and 5, cover 17 is reversible so that it can be attached to either the left or right side of a door. Once a choice has been made, liner 24 is attached, as by welding, to cover 17. Thus, a reduced inventory would be required as only parts 17 and 24 are required for use in either a left hand or right hand condition.

While the embodiment of the invention has been shown attached to secure a vertically positioned door, the lock assembly could also be readily adapted for securing deck hatches, cabinets, lockers, and the like, where items are to be secured.

Obviously many modifications and variations of the present invention are possible in the light of the above teachings. It is therefore to be understood that the invention may be practiced otherwise than as specifically described.

We claim:

1. A high security locking system for securing together first and second members comprising, lock shackle pins, means for attaching said lock shackle pins to a first member, a cover assembly attached to a second member and having an end opening sufficiently large to allow passage of said shackle pins and having a bottom opening larger than said end opening, and a lock engageable with said shackle pins having a size sufficiently small to pass through said bottom opening but too large to pass through said end opening whereby said lock and said shackle pins are enclosed by said cover assembly when said lock is engaged with said shackle pins and said first and second members are secured together.

2. A high security locking system for securing together first and second members as set forth in claim 1 wherein said cover assembly is pivotally attached to said second member by a hinge.

3. A high security locking system for securing together first and second members as set forth in claim 1 wherein said cover assembly comprises a U-shaped cover having an opened top, an opened bottom and an opened end, and an inner liner attached to said U-shaped cover closing said opened top and partially closing said opened end.

4. A high security locking system for securing together first and second members as set forth in claim 3 wherein said inner liner is welded to said U-shaped cover.

5. A high security locking system for securing together first and second members as set forth in claim 3 wherein said U-shaped cover has an outwardly extending flange for facilitating attachement to said second member.

6. A high security locking system for securing together first and second members as set forth in claim 2 wherein said cover assembly comprises a U-shaped cover having an outwardly extending flange, an opened top, an opened bottom and an opened end, and an inner liner attached to said U-shaped cover closing said opened top and partially closing said opened end and wherein said outwardly extending flange is welded to said hinge.

* * * * *